US006761040B2

(12) United States Patent
Ahn et al.

(10) Patent No.: US 6,761,040 B2
(45) Date of Patent: Jul. 13, 2004

(54) CROSS FLOW FAN AND AIR CONDITIONER FITTED WITH THE SAME

(75) Inventors: Cheol O Ahn, Seoul (KR); Sim Won Chin, Gwangmyong-shi (KR); Chang Seon Lee, Seoul (KR); Mun Kee Chung, Seoul (KR); In Cheol Yun, Anyang-shi (KR); Dong Soo Moon, Seoul (KR); In Hwa Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/413,303

(22) Filed: Apr. 15, 2003

(65) Prior Publication Data

US 2003/0192337 A1 Oct. 16, 2003

(30) Foreign Application Priority Data

Apr. 16, 2002 (KR) ..... P2002-0020678

(51) Int. Cl.[7] ..... F25D 17/06

(52) U.S. Cl. ..... 62/426; 416/203

(58) Field of Search ..... 62/426, 455, 404, 62/411, 413, 414, 186, 255; 165/124, 122; 415/53.1; 416/178, 203, DIG. 2

(56) References Cited

U.S. PATENT DOCUMENTS 4,538,963 A * 9/1985 Sugio et al. ..... 416/203
4,958,504 A * 9/1990 Ichikawa et al. ..... 62/244
5,064,346 A * 11/1991 Atarashi et al. ..... 416/178
5,266,007 A * 11/1993 Bushnell et al. ..... 416/178
5,573,059 A * 11/1996 Hamamoto et al. ..... 165/124
5,664,428 A * 9/1997 Sugiyama et al. ..... 62/259.1
6,050,773 A * 4/2000 Bushnell ..... 415/53.1
6,149,381 A * 11/2000 Lee ..... 415/53.1
6,158,954 A * 12/2000 Nabeshima et al. ..... 415/53.1
6,345,951 B1 * 2/2002 Choi ..... 415/1
2003/0194311 A1 10/2003 Ahn et al.

FOREIGN PATENT DOCUMENTS

JP 405272781 A * 10/1993
JP 405340379 A * 12/1993
JP 408177787 A * 7/1996
JP 408312978 A * 11/1996

* cited by examiner

*Primary Examiner*—William E. Tapolcai
*Assistant Examiner*—Mohammad M. Ali
(74) *Attorney, Agent, or Firm*—Greenblum & Bernstein, P.L.C.

(57) ABSTRACT

Cross flow fan, and air conditioner fitted with the same, the cross flow fan including a plurality of annular rims arranged at regular intervals along a horizontal direction, and a plurality of blades on a side surface of the rim vertical thereto, and along a circumference direction of the rim, wherein pitch angles between two adjacent blades are not regular, the pitch angle taking a center of the rim as an apex, and a number of blades are 32 or 35. The pitch angles of the blades are designed by a computer optimization method taking a number of the blades and the like as parameters.

10 Claims, 8 Drawing Sheets

$P_1 = P_2 = P_3 = P_4 = \cdots P_n$

FIG. 6

| | Pn[Deg] | An[Deg] |
|---|---|---|
| 1 | 12.50 | 12.50 |
| 2 | 9.22 | 21.72 |
| 3 | 10.00 | 31.72 |
| 4 | 12.43 | 44.14 |
| 5 | 11.14 | 55.28 |
| 6 | 14.08 | 69.36 |
| 7 | 8.85 | 78.21 |
| 8 | 12.19 | 90.41 |
| 9 | 12.39 | 102.79 |
| 10 | 9.84 | 112.63 |
| 11 | 11.21 | 123.84 |
| 12 | 9.41 | 133.26 |
| 13 | 14.93 | 148.18 |
| 14 | 10.96 | 159.15 |
| 15 | 8.18 | 167.32 |
| 16 | 11.62 | 178.94 |
| 17 | 12.91 | 191.86 |
| 18 | 12.00 | 203.86 |
| 19 | 11.93 | 215.79 |
| 20 | 10.18 | 225.97 |
| 21 | 8.33 | 234.31 |
| 22 | 12.34 | 246.64 |
| 23 | 10.00 | 256.64 |
| 24 | 13.90 | 270.54 |
| 25 | 9.66 | 280.21 |
| 26 | 12.18 | 292.39 |
| 27 | 11.87 | 304.26 |
| 28 | 12.80 | 317.06 |
| 29 | 11.11 | 328.17 |
| 30 | 11.23 | 339.39 |
| 31 | 8.44 | 347.84 |
| 32 | 12.16 | 360.00 |

FIG. 8

| | Pn[Deg] | An[Deg] |
|---|---|---|
| 1 | 10.00 | 10.00 |
| 2 | 10.31 | 20.31 |
| 3 | 9.20 | 29.51 |
| 4 | 11.64 | 41.15 |
| 5 | 10.37 | 51.52 |
| 6 | 10.67 | 62.19 |
| 7 | 9.41 | 71.60 |
| 8 | 12.26 | 83.86 |
| 9 | 8.36 | 92.22 |
| 10 | 10.25 | 102.47 |
| 11 | 11.47 | 113.94 |
| 12 | 8.27 | 122.22 |
| 13 | 11.33 | 133.54 |
| 14 | 11.08 | 144.62 |
| 15 | 9.36 | 153.98 |
| 16 | 11.29 | 165.28 |
| 17 | 7.67 | 172.94 |
| 18 | 13.44 | 186.39 |
| 19 | 10.10 | 196.49 |
| 20 | 9.97 | 206.46 |
| 21 | 8.08 | 214.53 |
| 22 | 10.26 | 224.80 |
| 23 | 13.64 | 238.43 |
| 24 | 8.33 | 246.76 |
| 25 | 9.89 | 256.65 |
| 26 | 10.71 | 267.37 |
| 27 | 9.54 | 276.91 |
| 28 | 12.51 | 289.42 |
| 29 | 7.95 | 297.37 |
| 30 | 11.76 | 309.13 |
| 31 | 7.92 | 317.05 |
| 32 | 13.47 | 330.52 |
| 33 | 10.81 | 341.33 |
| 34 | 7.80 | 349.13 |
| 35 | 10.87 | 360.00 |

CROSS FLOW FAN AND AIR CONDITIONER FITTED WITH THE SAME

This application claims the benefit of the Korean Application No. P2002-20678 filed on Apr. 16, 2002, which is hereby incorporated by reference.

BACKGROUND OF THE INVENTION

1. Field of the Invention

The present invention relates to cross flow fans, and more particularly, to a cross flow fan with unequal pitches, and an air conditioner fitted with the same.

2. Background of the Related Art

In general, the air conditioner is provided with an indoor unit and an outdoor unit, and the indoor unit is provided with an evaporator and fan fitted therein. The fan serves to draw air from a room, to make the air heat exchange at the evaporator, and to blow the air into the room again.

Of the fans employed in the air conditioners, there are sirocco fans, propeller fans, turbo fans, and cross flow fans, wherein the cross flow fans are mostly employed in the indoor units.

A related art cross flow fan in an air conditioner will be described with reference to the attached drawings.

Referring to FIG. 1, the air conditioner is provided with a casing having an inlet 4 and an outlet 5, an evaporator 1, a rear guide 2, a cross flow fan 10, and a stabilizer 3.

The cross flow fan 10 is fitted among the evaporator 1, the rear guide 2 and the stabilizer 3. The cross flow fan draws air through the inlet 4 and discharges through the outlet 5, and generates a vortex as the cross flow fan is rotated by a motor (not shown).

The evaporator 1 between the inlet 4 and the cross flow fan 10 heat exchanges with the air drawn through the inlet 4. The rear guide 2 in rear of the cross flow fan 10 stabilizes the vortex caused by the cross flow fan, and guides air flow. The stabilizer 3 under the cross flow fan 10 separates an inlet 4 region and an outlet 5 region, and stabilizes the air flow toward the outlet 5.

The cross flow fan 10 will be described in more detail.

Referring to FIG. 2, the cross flow fan 10 is provided with a plurality of blocks 11 joined along a rotation shaft B-B' direction. Each block 11 has a plurality of annular rims 13 arranged at equal intervals along a horizontal direction, and a plurality of blades 12 arranged on a side surface of the rim 13 vertical thereto, and along a circumference direction of the rim 13.

Referring to FIG. 3, each blade 12 forms a pitch angle Pn to an adjacent blade 12 with reference to a center of the rim 13. The pitch angle Pn is an angle between two adjacent blades 12, with the center of the rim 13 taken as an apex.

The cross flow fan 10 with equal pitched angles is called as an equal pitched cross flow fan 10. The equal pitched cross flow fan 10, having a good fan balance and a low vibration, and is favorable for mass production, is widely used.

However, variations of a pressure at regular intervals cause noise at a particular frequency. The equal pitched cross flow fan 10 has a regular pressure variation when the equal pitched cross flow fan 10 rotates at a constant speed, owing to the regular intervals of the blades 12, i.e., regular pitch angles Pn. Consequently, a sound pressure becomes higher at the particular frequency to cause unpleasant noise.

It is known that the noise is generated at a Blade Passing Frequency (BPF) defined as the following equation.

$$f_{BPF} = \frac{NZ}{60}$$

Where, 'N' denotes revolutions per min. and Z denotes a number of blades.

For an example, a measurement of sound pressure levels of a rotating equal pitched cross flow fan 10 with 32 blades provides a result as shown in FIG. 4.

Referring to FIG. 4, it can be noted that there are peaks of the sound pressure at approx. 800 Hz frequency intervals. This implies that the unpleasant noise occurs at regular frequency intervals.

Thus, the related art equal pitched cross flow fan 10 has poor noise characteristics due to the loud rotational frequency noise of the blades 12.

SUMMARY OF THE INVENTION

Accordingly, the present invention is directed to a cross flow fan, and an air conditioner fitted with the same that substantially obviates one or more of the problems due to limitations and disadvantages of the related art.

An object of the present invention is to provide a cross flow fan which has a reduced noise and vibration, and an air conditioner fitted with the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the cross flow fan includes a plurality of annular rims arranged at regular intervals along a horizontal direction, and a plurality of blades on a side surface of the rim vertical thereto, and along a circumference direction of the rim, wherein pitch angles between two adjacent blades are not regular, the pitch angle taking a center of the rim as an apex.

When a number of the blades are 32, the pitch angles of the blades arranged in succession in a clockwise or counter clockwise direction with reference to one of the blades are 12.50°, 9.22°, 10.00°, 12.43°, 11.14°, 14.08°, 8.85°, 12.19°, 12.39°, 9.84°, 11.21°, 9.41°, 14.93°, 10.96°, 8.18°, 11.62°, 12.91°, 12.00°, 11.93°, 10.18°, 8.33°, 12.34°, 10.00°, 13.90°, 9.66°, 12.18°, 11.87°, 12.80°, 11.11°, 11.23°, 8.44°, and 12.16°.

If the 32 blades are sloped in a clockwise or counter clockwise direction when seen from the side, the pitch angles of the blades arranged in succession in a clockwise or counter clockwise direction with reference to one of the blades are 12.50°, 9.22°, 10.00°, 12.43°, 11.14°, 14.08°, 8.85°, 12.19°, 12.39°, 9.84°, 11.21°, 9.41°, 14.93°, 10.96°, 8.18°, 11.62°, 12.91°, 12.00°, 11.93°, 10.18°, 8.33°, 12.34°, 10.00°, 13.90°, 9.66°, 12.18°, 11.87°, 12.80°, 11.11°, 11.23°, 8.44°, and 12.16°.

When a number of the blades are 35, the pitch angles of the blades arranged in succession in a clockwise or counter clockwise direction with reference to one of the blades are 10.00°, 10.31°, 9.20°, 11.64°, 10.37°, 10.67°, 9.41°, 12.26°, 8.36°, 10.25°, 11.47°, 8.27°, 11.33°, 11.08°, 9.36°, 11.29°, 7.67°, 13.44°, 10.10°, 9.97°, 8.08°, 10.26°, 13.34°, 8.33°, 9.89°, 10.71°, 9.54°, 12.51°, 7.95°, 11.76°, 7.92°, 13.47°, 10.81°, 7.80°, and 10.87°.

In another aspect of the present invention, there is provided an air conditioner including a casing having an inlet and an outlet, a cross flow fan for drawing air through the inlet and discharging the air through the outlet, the cross flow fan including a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex, and an evaporator between the inlet and the cross flow fan for making heat exchange with the air drawn through the inlet.

The air conditioner further includes a rear guide in rear of the cross flow fan for stabilizing a vortex occurred by the cross flow fan, and guiding flow of the air, and/or a stabilizer under the cross flow fan to separate the inlet region and the outlet region, for stabilizing flow of the air moving toward the outlet.

When a number of the blades are 32, the pitch angles of the blades arranged in succession in a clockwise or counter clockwise direction with reference to one of the blades are 12.50°, 9.22°, 10.00°, 12.43°, 11.14°, 14.08°, 8.85°, 12.19°, 12.39°, 9.84°, 11.21°, 9.41°, 14.93°, 10.96°, 8.18°, 11.62°, 12.91°, 12.00°, 11.93°, 10.18°, 8.33°, 12.34°, 10.00°, 13.90°, 9.66°, 12.18°, 11.87°, 12.80°, 11.11°, 11.23°, 8.44°, and 12.16°.

If the 32 blades are sloped in a clockwise or counter clockwise direction when seen from the side, the pitch angles of the blades arranged in succession in a clockwise or counter clockwise direction with reference to one of the blades are 12.50°, 9.22°, 10.00°, 12.43°, 11.14°, 14.08°, 8.85°, 12.19°, 12.39°, 9.84°, 11.21°, 9.41°, 14.93°, 10.96°, 8.18°, 11.62°, 12.91°, 12.00°, 11.93°, 10.18°, 8.33°, 12.34°, 10.00°, 13.90°, 9.66°, 12.18°, 11.87°, 12.80°, 11.11°, 11.23°, 8.44°, and 12.16°.

When a number of the blades are 35, the pitch angles of the blades arranged in succession in a clockwise or counter clockwise direction with reference to one of the blades are 10.00°, 10.31°, 9.20°, 11.64°, 10.37°, 10.67°, 9.41°, 12.26°, 8.36°, 10.25°, 11.47°, 8.27°, 11.33°, 11.08°, 9.36°, 11.29°, 7.67°, 13.44°, 10.10°, 9.97°, 8.08°, 10.26°, 13.34°, 8.33°, 9.89°, 10.71°, 9.54°, 12.51°, 7.95°, 11.76°, 7.92°, 13.47°, 10.81°, 7.80°, and 10.87°.

If the 35 blades are sloped in a clockwise or counter clockwise direction when seen from the side, the pitch angles of the blades arranged in succession in a clockwise or counter clockwise direction with reference to one of the blades are 10.00°, 10.31°, 9.20°, 11.64°, 10.37°, 10.67°, 9.41°, 12.26°, 8.36°, 10.25°, 11.47°, 8.27°, 11.33°, 11.08°, 9.36°, 11.29°, 7.67°, 13.44°, 10.10°, 9.97°, 8.08°, 10.26°, 13.34°, 8.33°,9.89°, 10.71°, 9.54°, 12.51°, 7.95°, 11.76°, 7.92°, 13.47°, 10.81°, 7.80°, and 10.87°.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 6 illustrates a table showing pitch angles of blades, and accumulated pitch angles for an unequal pitched cross flow fan with 32 blades of the present invention;

FIG. 8 illustrates a table showing pitch angles of blades, and accumulated pitch angles for an unequal pitched cross flow fan with 35 blades of the present invention.

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, same parts will be given the same names and reference symbols, and repetitive description of which will be omitted.

Figure 5:
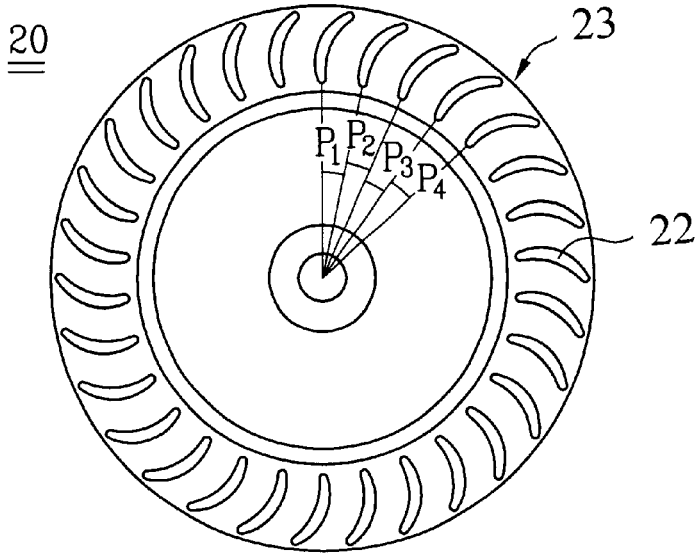
FIG. 5 illustrates a section showing an unequal pitched cross flow fan in accordance with a preferred embodiment of the present invention.

Referring to FIG. 5, the cross flow fan 20 of the present invention includes a plurality of rims 23 arranged at equal distances along a horizontal direction, and a plurality of blades 22 on a side surface of the rim 23 vertical thereto, and along a circumference direction of the rim 23.

The blades 22 are arranged such that pitch angles Pn between two adjacent blades 22 are not regular when a center of the rim 23 is taken as an apex.

When seen from a side, the blades 22 are sloped in a clockwise or a counter clockwise direction.

The foregoing cross flow fan of the present invention is an unequal pitched cross flow fan 20 designed to have irregular pitch angles Pn. This implies that distances between two adjacent blades 22 are different.

However, when the foregoing cross flow fan 20 is applied to an air conditioner, the irregular arrangement of the blades 22 is liable to cause vibration in rotation due to an eccentricity of weight.

Therefore, for solving the vibration problem ire the rotation, the cross flow fan 20 of the present invention is designed such that a standard deviation of the pitch angles Pn is within a certain level, and not to cause the eccentricity coming from the irregular arrangement of the blades 22.

Embodiments of the cross flow fan of the present invention will be described in detail, with reference to the attached drawings.

The embodiments of the present invention are illustrated in FIGS. 6 and 8 obtained from computer simulations carried out according to an optimization method, taking a number of blades 22, and a number of the blocks 11 as parameters.

FIG. 6 illustrates a table showing pitch angles Pn of blades 22, and accumulated pitch angles An for a cross flow fan 20 with 32 blades in an air conditioner in accordance with a first preferred embodiment of the present invention.

The accumulated pitch angle An denotes addition of the pitch angles Pn of the blades 22 in a clockwise or counter clockwise direction in succession.

The cross flow fan 20, an unequal pitched cross flow fan 20 with irregular pitches, includes 32 blades 22, and the pitch angle Pn and the accumulated pitch angle An have the following relation.

$$A_n = \sum_{n=0}^{32} P_n$$

When seen from a side, the blades 22 are sloped in a clockwise or counter clockwise direction.

Figure 7:
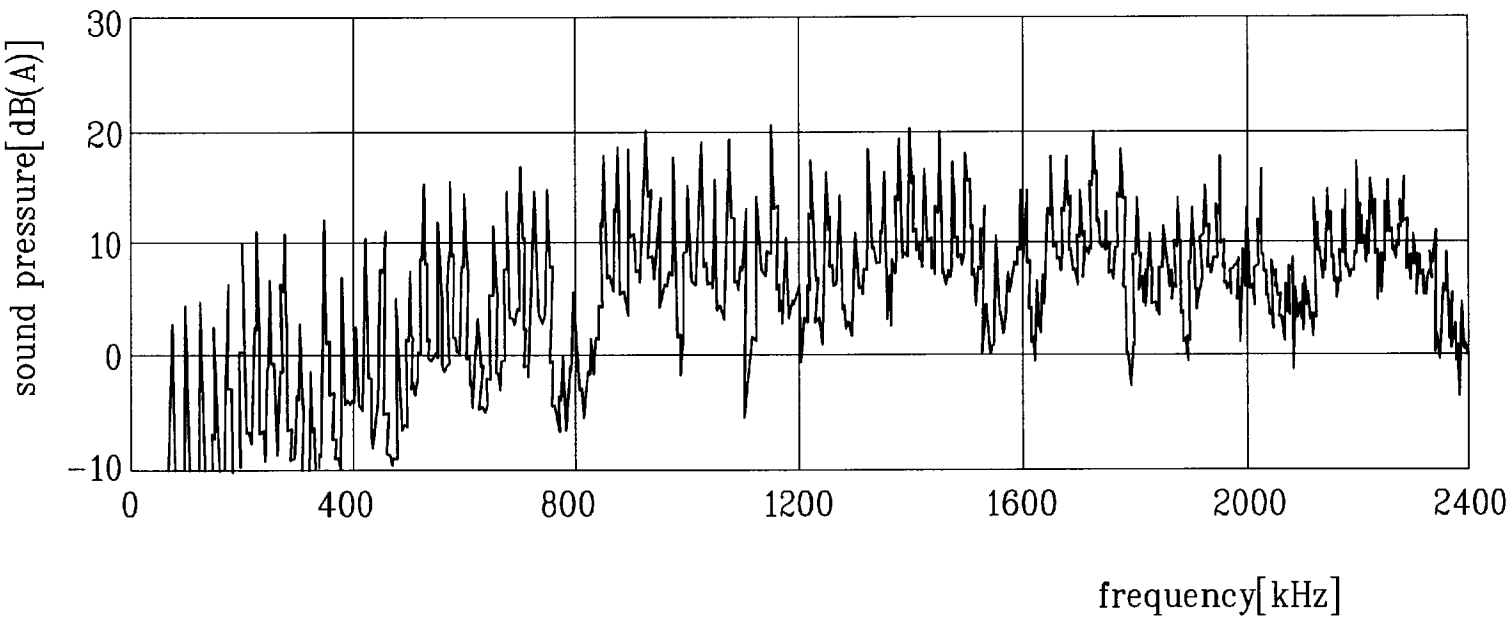
FIG. 7 illustrates a graph showing sound pressure levels occurred as the unequal pitched cross flow fan of the table in FIG. 6 rotates.

An operation result of the foregoing unequal pitched cross flow fan done by a computer simulation is illustrated in FIG. 7.

Figure 1:
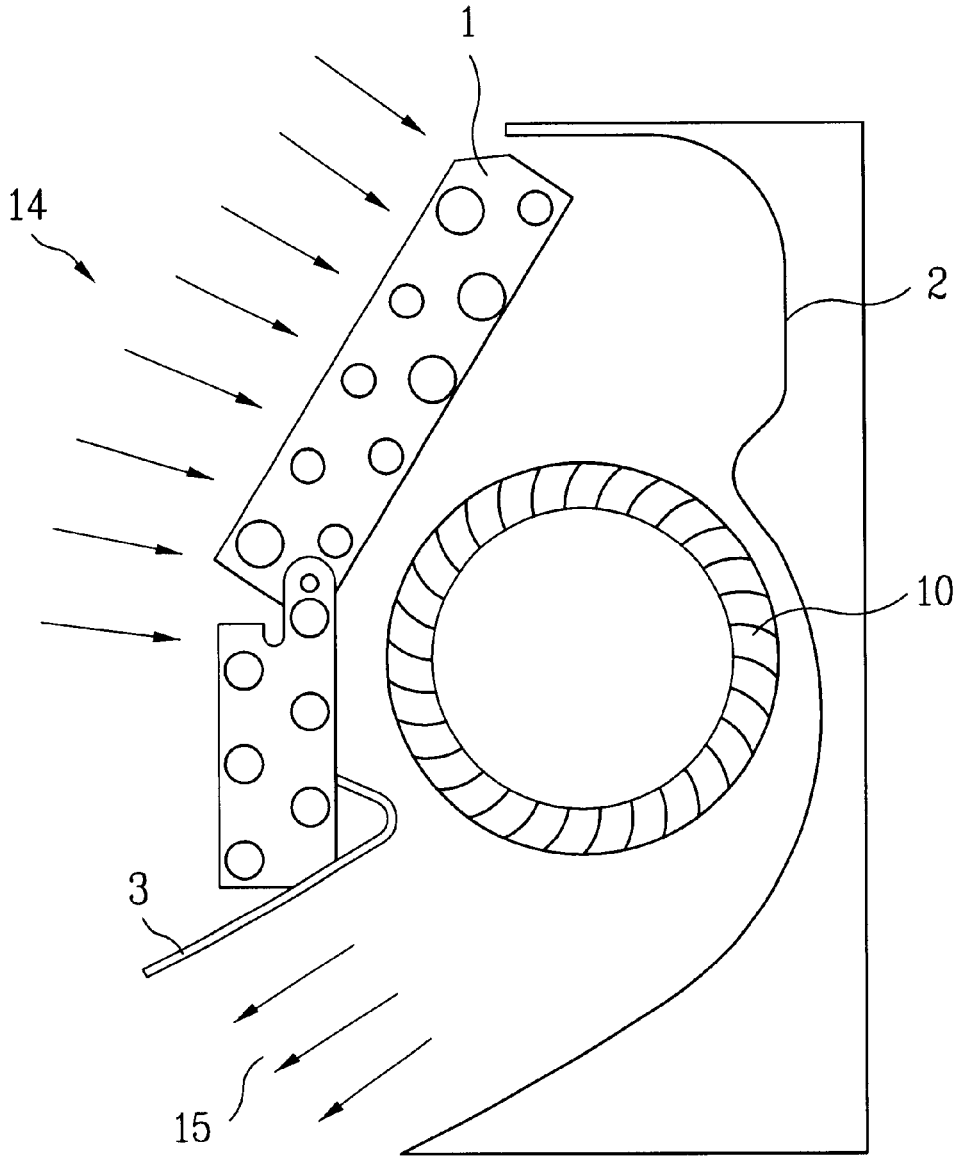
FIG. 1 Prior Art
FIG. 1 illustrates a diagram showing an inside structure of a separated type air conditioner, schematically.
Figure 2:
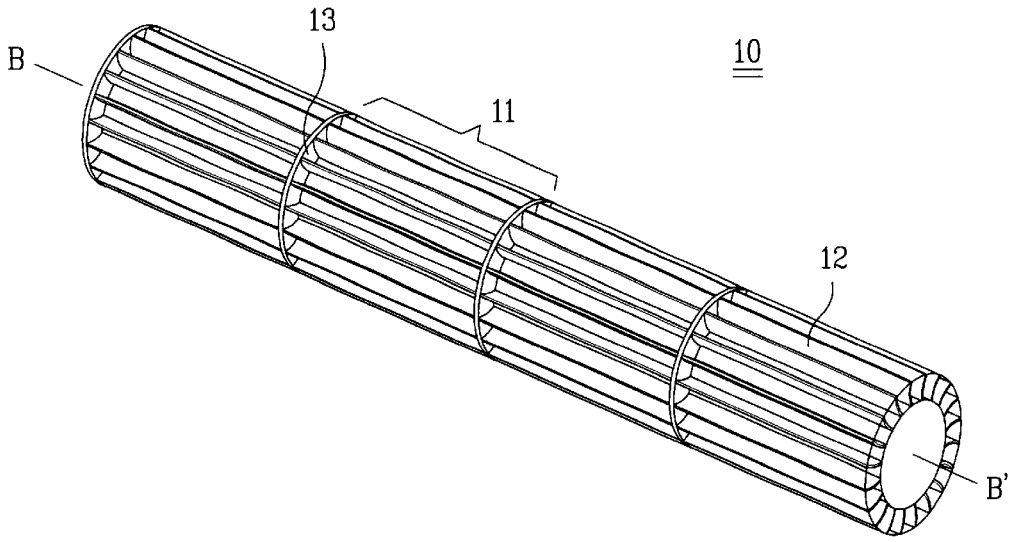
FIG. 2 Prior Art
FIG. 2 illustrates a perspective view of an equal pitched cross flow fan.
Figure 3:
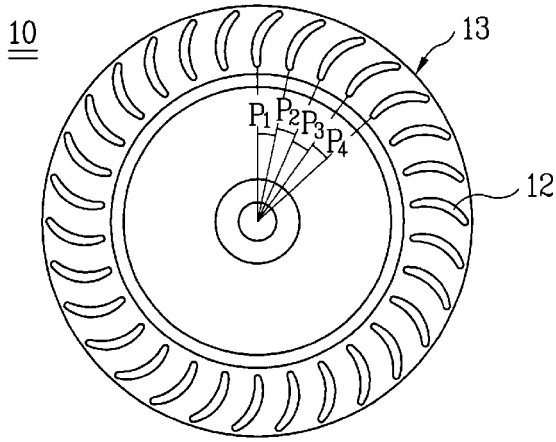
FIG. 3 Prior Art
FIG. 3 illustrates a section showing a blade arrangement of an equal pitched cross flow fan.
Figure 4:
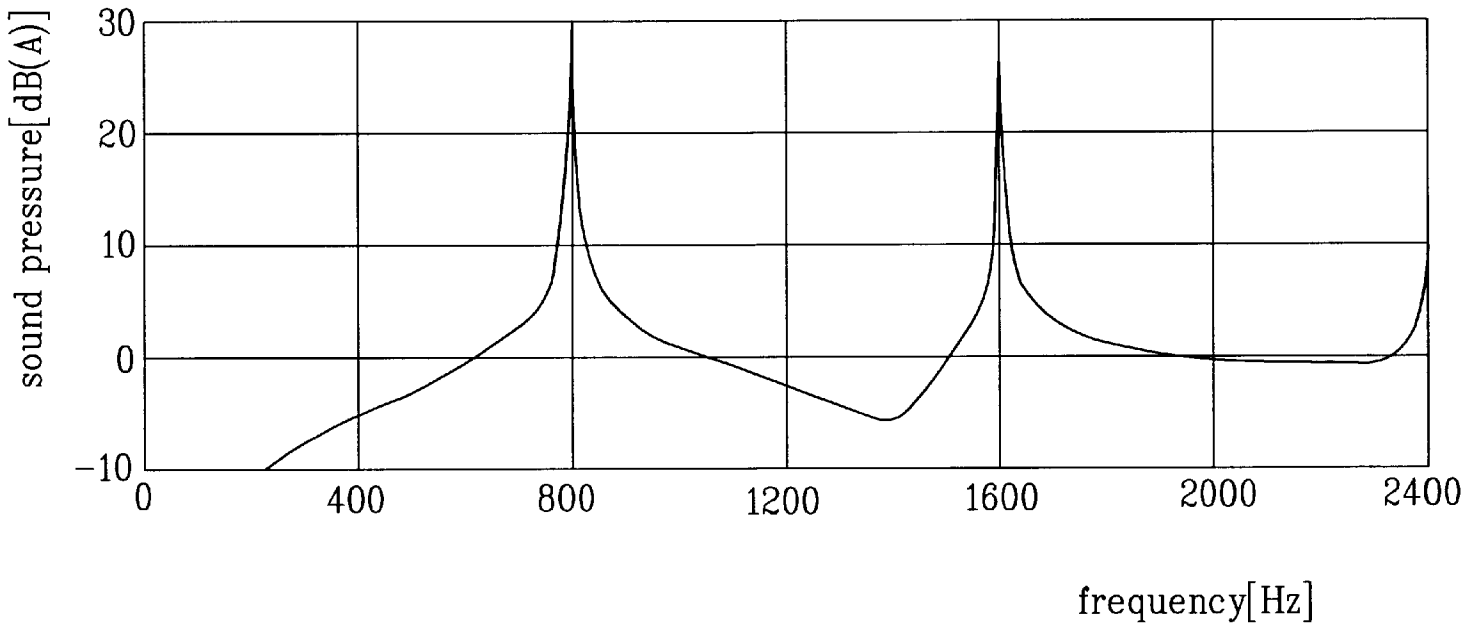
FIG. 4 Prior Art
FIG. 4 illustrates a graph showing sound pressure levels occurred as the equal pitch cross flow fan rotates.

Referring to FIG. 7, different from a related art cross flow fan 10 in FIG. 4, the unequal pitched cross flow fan 20 of the present invention shows no BPF noise. That is, it can be known that, since the sound pressure does not vary with a frequency significantly, the sound pressure has no large variation of amplitude, implying that there is no unpleasant noise caused by a high sound pressure occurred at a certain frequency like the related art.

Also, since the sound level is below 20 Hz mostly, it can be known that the noise is reduced significantly.

A second embodiment of the present invention will be described with reference to FIG. 8. FIG. 8 illustrates a table showing pitch angles Pn of blades 22, and accumulated pitch angles An for an unequal pitched cross flow fan 20 with 35 blades of the present invention. The accumulated pitch angle An denotes a sum of pitch angles Pn between the blades 22 arranged in succession along a clockwise or counter clockwise direction with reference to a blade.

The cross flow fan 20 is also an unequal pitched cross flow fan 20 with 35 blades having unequal pitch angles Pn, and the pitch angle Pn and the accumulated pitch angle An have the following relation.

$$A_n = \sum_{n=0}^{35} P_n$$

When seen from a side, the blades 22 are sloped in a clockwise or counter clockwise direction.

Figure 9:
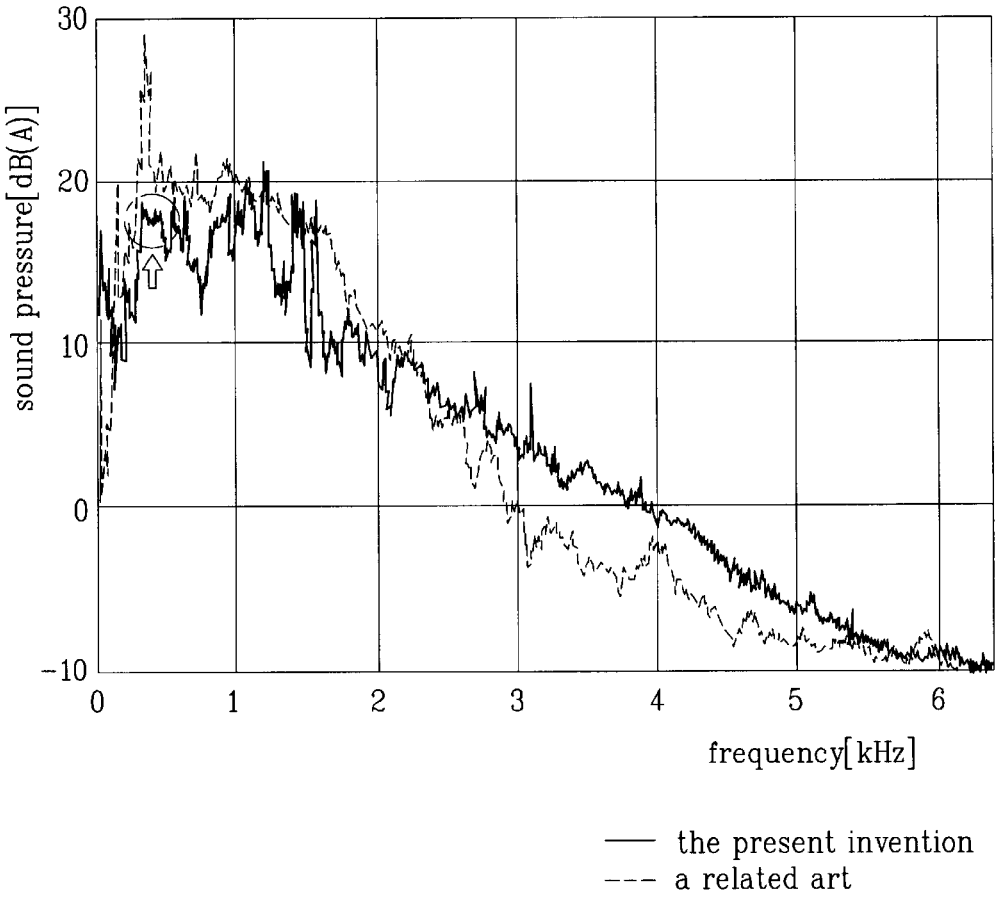
FIG. 9 illustrates a graph of a test result of sound pressure differences at BPF compared for cross flow fans of the related art and the present invention.

An operation result of the foregoing unequal pitched cross flow fan 20 done by a computer simulation is illustrated in FIG. 9.

Referring to FIG. 9, it can be noted that the cross flow fan 20 of the present invention shows a sound pressure at a BPF indicated with an arrow is below 20 dB, which is significantly dropped from the sound pressure of 30 dB in the related art.

Thus, the present invention provides a cross flow fan 20 with reduced noise and vibration by means of computer simulations using an optimization method. An air conditioner fitted with the cross flow fan is provided, too.

The cross flow fan of the present invention described up to now have 32 or 35 blades 22. However, the present invention is not limited thereto, but an optimized cross flow fan 20 can be provided to suit to required blades by means of computer simulation.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A cross flow fan comprising:

a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex, wherein a number of the blades are 32, and wherein the pitch angles of the blades arranged in succession in a clockwise or counter clockwise direction with reference to one of the blades are 12.50°, 9.22°, 10.00°, 12.43°, 11.14°, 14.08°, 8.85°, 12.19°, 12.39°, 9.84°, 11.21°, 9.41°, 14.93°, 10.96°, 8.18°, 11.62°, 12.91°, 12.00°, 11.93°, 10.18°, 8.33°, 12.34°, 10.00°, 13.90°, 9.66°, 12.18°, 11.87°, 12.80°, 11.11°, 11.23°, 8.44°, and 12.16°.

2. A cross flow fan comprising:

a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex, wherein a number of the blades are 32, wherein the blades are sloped in a clockwise or counter clockwise direction when seen from the side, and wherein the pitch angles of the blades arranged in succession in a clockwise or counter clockwise direction with reference to one of the blades are 12.50°, 9.22°, 10.00°, 12.43°, 11.14°, 14.08°, 8.85°, 12.19°, 12.39°, 9.84°, 11.21°, 9.41°, 14.93°, 10.96°, 8.18°, 11.62°, 12.91°, 12.00°, 11.93°, 10.18°, 8.33°, 12.34°, 10.00°, 13.90°, 9.66°, 12.18°, 11.87°, 12.80°, 11.11°, 11.23°, 8.44°, and 12.16°.

3. A cross flow fan comprising:

a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex, wherein a number of the blades are 35, and wherein the pitch angles of the blades arranged in succession in a clockwise or counter clockwise direction with reference to one of the blades are 10.00°, 10.31°, 9.20°, 11.64°, 10.37°, 10.67°, 9.41°, 12.26°, 8.36°, 10.25°, 11.47°, 8.27°, 11.33°, 11.08°, 9.36°, 11.29°, 7.67°, 13.44°, 10.10°, 9.97°, 8.08°, 10.26°, 13.34°, 8.33°, 9.89°, 10.71°, 9.54°, 12.51°, 7.95°, 11.76°, 7.92°, 13.47°, 10.81°, 7.80°, and 10.87°.

4. A cross flow fan comprising:

a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex, wherein a number of the blades are 35, wherein the blades are sloped in a clockwise or counter clockwise direction when seen from the side, and wherein the pitch angles of the blades arranged in succession in a clockwise or counter clockwise direction with reference to one of the blades are 10.00°, 10.31°, 9.20°, 11.64°, 10.37°, 10.67°, 9.41°, 12.26°, 8.36°, 10.25°, 11.47°, 8.27°, 11.33°, 11.08°, 9.36°, 11.29°, 7.67°, 13.44°, 10.10°, 9.97°, 8.08°, 10.26°, 13.34°, 8.33°, 9.89°, 10.71°,9.54°, 12.51°, 7.95°, 11.76°, 7.92°, 13.47°, 10.81°, 7.80°, and 10.87°.

5. An air conditioner comprising:

a casing having an inlet and an outlet;

a cross flow fan for drawing air through the inlet and discharging the air through the outlet, the cross flow fan including a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex; and an evaporator between the inlet and the cross flow fan for making heat exchange with the air drawn through the inlet, wherein a number of the blades are 32, and wherein the pitch angles of the blades arranged in succession in a clockwise or counter clockwise direction with reference to one of the blades are 12.50°, 9.22°, 10.00°, 12.43°, 11.14°, 14.08°, 8.85°, 12.19°, 12.39°, 9.84°, 11.21°, 9.41°, 14.93°, 10.96°, 8.18°, 11.62°, 12.91°, 12.00°, 11.93°, 10.18°, 8.33°, 12.34°, 10.00°, 13.90°, 9.66°, 12.18°, 11.87°, 12.80°, 11.11°, 11.23°, 8.44°, and 12.16°.

6. An air conditioner comprising:

a casing having an inlet and an outlet;

a cross flow fan for drawing air through the inlet and discharging the air through the outlet, the cross flow fan including a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex; and an evaporator between the inlet and the cross flow fan for making heat exchange with the air drawn through the inlet, wherein a number of the blades are 32, wherein the blades are sloped in a clockwise or counter clockwise direction when seen from the side, and wherein the pitch angles of the blades arranged in succession in a clockwise or counter clockwise direction with reference to one of the blades are 12.50°, 9.22°, 10.00°, 12.43°, 11.14°, 14.08°, 8.85°, 12.19°, 12.39°, 9.84°, 11.21°, 9.41°, 14.93°, 10.96°, 8.18°, 11.62°, 12.91°, 12.00°, 11.93°, 10.18°, 8.33°, 12.34°, 10.00°, 13.90°, 9.66°, 12.18°, 11.87°, 12.80°, 11.11°, 11.23°, 8.44°, and 12.16°.

7. An air conditioner comprising:

a casing having an inlet and an outlet;

a cross flow fan for drawing air through the inlet and discharging the air through the outlet, the cross flow fan including a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex; and an evaporator between the inlet and the cross flow fan for making heat exchange with the air drawn through the inlet, wherein a number of the blades are 35, and wherein the pitch angles of the blades arranged in succession in a clockwise or counter clockwise direction with reference to one of the blades are 10.00°, 10.31°,9.20°, 11.64°, 10.37°, 10.67°, 9.41°, 12.26°, 8.36°, 10.25°, 11.47°, 8.27°, 11.33°, 11.08°, 9.36°, 11.29°, 7.67°, 13.44°, 10.10°, 9.97°, 8.08°, 10.26°, 13.34°, 8.33°, 9.89°, 10.71°, 9.54°, 12.51°, 7.95°, 11.76°, 7.92°, 13.47°, 10.81°, 7.80°, and 10.87°.

8. An air conditioner comprising:

a casing having an inlet and an outlet;

a cross flow fan for drawing air through the inlet and discharging the air through the outlet, the cross flow fan including a plurality of annular rims arranged at regular intervals along a horizontal direction; and a plurality of blades on a side surface of the rim vertical thereto, and along a circumference direction of the rim, wherein pitch angles between two adjacent blades are not regular, the pitch angle taking a center of the rim as an apex; and an evaporator between the inlet and the cross flow fan for making heat exchange with the air drawn through the inlet, wherein the blades are sloped in a clockwise or counter clockwise direction when seen from the side, and wherein the pitch angles of the blades arranged in succession in a clockwise or counter clockwise direction with reference to one of the blades are 10.00°, 10.31°, 9.20°, 11.64°, 10.37°, 10.67°, 9.41°, 12.26°, 8.36°, 10.25°, 11.47°, 8.27°, 11.33°, 11.08°, 9.36°, 11.29°, 7.67°, 13.44°, 10.10°, 9.97°, 8.08°, 10.26°, 13.34°, 8.33°, 9.89°, 10.71°, 9.54°, 12.51°, 7.95°, 11.76°, 7.92°, 13.47°, 10.81°, 7.80°, and 10.87°.

9. A cross flow fan with 32 blades arranged according to a table in FIG. 6 having a relation of $$A_n = \sum_{n=0}^{32} P_n,$$

where, Pn denotes a pitch angle between adjacent blades in a radial direction from a rotation center of the cross flow fan, and An denotes an accumulated pitch angle which is an accumulated angle of the pitch angles in a clockwise or counter clockwise direction.

10. A cross flow fan with 35 blades arranged according to a table in FIG. 8 having a relation of $$A_n = \sum_{n=0}^{35} P_n,$$

where, Pn denotes a pitch angle between adjacent blades in a radial direction from a rotation center of the cross flow fan, and An denotes an accumulated pitch angle which is an accumulated angle of the pitch angles in a clockwise or counter clockwise direction.

* * * * *